US006697582B1

(12) United States Patent
Scheuer

(10) Patent No.: US 6,697,582 B1
(45) Date of Patent: Feb. 24, 2004

(54) DYNAMIC CONTROL PATCHES FOR BETTER TRC CONTROL

(75) Inventor: Mark A. Scheuer, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/342,827

(22) Filed: Jan. 15, 2003

(51) Int. Cl.[7] ..... G03G 15/00; G03G 15/08
(52) U.S. Cl. ..... 399/49; 399/53
(58) Field of Search ..... 358/1.9, 520; 399/49, 399/53, 72; 430/120

(56) References Cited

U.S. PATENT DOCUMENTS

| | | | |
|---|---|---|---|
| 4,500,198 | A | 2/1985 | Daniels |
| 5,402,214 | A | 3/1995 | Henderson |
| 5,471,313 | A | 11/1995 | Thieret et al. |
| 5,649,072 | A | 7/1997 | Balasubramanian |
| 5,708,916 | A | 1/1998 | Mestha |
| 5,739,927 | A | 4/1998 | Balasubramanian et al. |
| 5,749,019 | A | 5/1998 | Mestha |
| 5,749,021 | A | 5/1998 | Mestha et al. |
| 5,754,918 | A | 5/1998 | Mestha et al. |
| 5,777,656 | A | 7/1998 | Henderson |
| 5,884,118 | A | 3/1999 | Mestha et al. |
| 6,175,698 | B1 | 1/2001 | Scheuer et al. |
| 6,201,936 | B1 | 3/2001 | Gross et al. |
| 6,208,767 | B1 | 3/2001 | Chapin |
| 6,236,474 | B1 | 5/2001 | Mestha et al. |
| 6,295,137 | B1 | 9/2001 | Balasubramanian |

*Primary Examiner*—Hoang Ngo
(74) *Attorney, Agent, or Firm*—Fay, Sharpe, Fagan, Minnich & McKee, LLP

(57) ABSTRACT

An actual tone reproduction curve of an electrophotographic system is controlled at several points to coincide with a target tone reproduction curve. The several points are referred to as level 2 control points. The level 2 control points are dynamically selected to, for example, minimize an aspect of error between the actual tone reproduction curve and the target tone reproduction curve. Test patches are generated in association with target test patch densities. Actual test patch densities are measured. An approximation of the actual tone reproduction curve is fit to the measured data. New level 2 control points are selected to minimize an aspect of deviation or error between the actual tone reproduction curve and the target tone reproduction curve. A system operative to dynamically select the level 2 control points includes means for selecting optimum level 2 control points.

22 Claims, 10 Drawing Sheets

310

| 314 Input Contone Value | 318 Color Corrected Contone Value | 314 Input Contone Value | 318 Color Corrected Contone Value | 314 Input Contone Value | 318 Color Corrected Contone Value |
|---|---|---|---|---|---|
| 150 | 153 | 185 | 322 174 | 220 | 206 |
| 151 | 322 154 | 186 | 174 | 221 | 207 |
| 152 | 154 | 187 | 175 | 222 | 208 |
| 153 | 322 155 | 188 | 322 176 | 223 | 330 209 |
| 154 | 155 | 189 | 176 | 224 | 211 |
| 155 | 156 | 190 | 177 | 225 | 212 |
| 156 | 322 157 | 191 | 178 | 226 | 330 213 |
| 157 | 157 | 192 | 322 179 | 227 | 215 |
| 158 | 322 158 | 193 | 179 | 228 | 216 |
| 159 | 158 | 194 | 180 | 229 | 330 217 |
| 160 | 322 159 | 195 | 181 | 230 | 219 |
| 161 | 159 | 196 | 182 | 231 | 220 |
| 162 | 160 | 197 | 322 183 | 232 | 330 221 |
| 163 | 322 161 | 198 | 183 | 233 | 223 |
| 164 | 161 | 199 | 184 | 234 | 224 |
| 165 | 322 162 | 200 | 185 | 235 | 330 225 |
| 166 | 162 | 201 | 186 | 236 | 227 |
| 167 | 322 163 | 202 | 187 | 237 | 330 228 |
| 168 | 163 | 203 | 188 | 238 | 230 |
| 169 | 322 164 | 204 | 189 | 239 | 330 231 |
| 170 | 164 | 205 | 190 | 240 | 233 |
| 171 | 165 | 206 | 191 | 241 | 234 |
| 172 | 322 166 | 207 | 192 | 242 | 330 235 |
| 173 | 166 | 208 | 193 | 243 | 237 |
| 174 | 322 167 | 209 | 194 | 244 | 238 |
| 175 | 167 | 210 | 195 | 245 | 240 |
| 176 | 168 | 211 | 196 | 246 | 330 241 |
| 177 | 322 169 | 212 | 197 | 247 | 243 |
| 178 | 169 | 213 | 198 | 248 | 330 244 |
| 179 | 322 170 | 214 | 199 | 249 | 246 |
| 180 | 170 | 215 | 200 | 250 | 330 247 |
| 181 | 171 | 216 | 201 | 251 | 249 |
| 182 | 322 172 | 217 | 202 | 252 | 330 250 |
| 183 | 172 | 218 | 326 203 | 253 | 252 |
| 184 | 173 | 219 | 205 | 254 | 330 253 |
| | | | | 255 | 255 |

FIG. 3

810

| 314 Input Contone Value | 318 Color Corrected Value (From FIG. 3) | 818 New Color Value |
|---|---|---|
| 150 | 153 | 154 |
| 151 | 154 (322) | 155 (822) |
| 152 | 154 | 155 |
| 153 | 155 (322) | 156 |
| 154 | 155 | 157 (822) |
| 155 | 156 | 157 |
| 156 | 157 (322) | 158 |
| 157 | 157 | 159 (822) |
| 158 | 158 (322) | 159 |
| 159 | 158 | 160 |
| 160 | 159 (322) | 161 (822) |
| 161 | 159 | 161 |
| 162 | 160 | 162 |
| 163 | 161 (322) | 163 (822) |
| 164 | 161 | 163 |
| 165 | 162 (322) | 164 |
| 166 | 162 | 165 (822) |
| 167 | 163 (322) | 165 |
| 168 | 163 | 166 (822) |
| 169 | 164 (322) | 166 |
| 170 | 164 | 167 |
| 171 | 165 | 168 (822) |
| 172 | 166 (322) | 168 |
| 173 | 166 | 169 |
| 174 | 167 (322) | 170 (822) |
| 175 | 167 | 170 |
| 176 | 168 | 171 |
| 177 | 169 (322) | 172 (822) |
| 178 | 169 | 172 |
| 179 | 170 (322) | 173 |
| 180 | 170 | 174 (822) |
| 181 | 171 | 174 |
| 182 | 172 (322) | 175 |
| 183 | 172 | 176 (822) |
| 184 | 173 | 176 |

| 314 Input Contone Value | 318 818 Color Corrected Value (From FIG. 3) | 818 New Color Value |
|---|---|---|
| 185 | 174 (322) | 177 |
| 186 | 174 | 178 |
| 187 | 175 | 179 (822) |
| 188 | 176 (322) | 179 |
| 189 | 176 | 180 |
| 190 | 177 | 181 |
| 191 | 178 | 182 (822) |
| 192 | 179 (322) | 182 |
| 193 | 179 | 183 |
| 194 | 180 | 184 |
| 195 | 181 | 185 |
| 196 | 182 | 186 (822) |
| 197 | 183 (322) | 186 |
| 198 | 183 | 187 |
| 199 | 184 | 188 |
| 200 | 185 | 189 |
| 201 | 186 | 190 |
| 202 | 187 | 191 |
| 203 | 188 | 192 |
| 204 | 189 | 193 |
| 205 | 190 | 194 |
| 206 | 191 | 195 (822) |
| 207 | 192 | 195 |
| 208 | 193 | 196 |
| 209 | 194 | 197 |
| 210 | 195 | 198 |
| 211 | 196 | 199 |
| 212 | 197 | 200 |
| 213 | 198 | 202 |
| 214 | 199 | 203 |
| 215 | 200 | 204 |
| 216 | 201 | 205 |
| 217 | 202 | 206 |
| 218 (326) | 203 | 207 |
| 219 | 205 | 208 |

| 314 Input Contone Value | 318 818 Color Corrected Value (From FIG. 3) | 818 New Color Value |
|---|---|---|
| 220 | 206 | 209 |
| 221 | 207 | 210 |
| 222 | 208 | 211 (830) |
| 223 (330) | 209 | 213 |
| 224 | 211 | 214 |
| 225 | 212 | 215 |
| 226 (330) | 213 | 216 |
| 227 | 215 | 217 (830) |
| 228 | 216 | 219 |
| 229 (330) | 217 | 220 |
| 230 | 219 | 221 |
| 231 | 220 | 222 (830) |
| 232 (330) | 221 | 224 |
| 233 | 223 | 225 |
| 234 | 224 | 226 (830) |
| 235 (330) | 225 | 228 |
| 236 | 227 | 229 |
| 237 (330) | 228 | 230 (830) |
| 238 | 230 | 232 |
| 239 (330) | 231 | 233 |
| 240 | 233 | 234 (830) |
| 241 | 234 | 236 |
| 242 (330) | 235 | 237 |
| 243 | 237 | 238 (830) |
| 244 | 238 | 240 |
| 245 | 240 | 241 |
| 246 (330) | 241 | 242 (830) |
| 247 | 243 | 244 |
| 248 (330) | 244 | 245 (830) |
| 249 | 246 | 247 |
| 250 (330) | 247 | 248 |
| 251 | 249 | 249 (830) |
| 252 (330) | 250 | 251 |
| 253 | 252 | 252 (830) |
| 254 (330) | 253 | 254 |
| 255 | 255 | 255 |

FIG. 8

DYNAMIC CONTROL PATCHES FOR BETTER TRC CONTROL

BACKGROUND

The present invention relates to electrophotographic printing. It finds particular application in conjunction with a method and system for controlling a printing device's tone reproduction curve (TRC). The invention helps minimize contouring and maximize a number of shades or colors available for an output image. The invention will be described in reference to a xerographic print engine. However, the invention is also. amenable to other electrophotographic processes, such as for example, ionographic print engines and like applications.

Electrophotographic copiers, printers and digital imaging systems typically record an electrostatic latent image on an imaging member. The latent image corresponds to the informational areas contained within a document being reproduced. In xerographic systems, a uniform charge is placed on a photoconductive member and portions of the photoconductive member are discharged by a scanning laser or other light source to create the latent image. In ionographic print engines the latent image is written to an insulating member by a beam of charge carriers, such as, for example, electrons. However it is created, the latent image is then developed by bringing a developer, including colorants, such as, for example, toner particles into contact with the latent image. The toner particles carry a charge and are attracted away from a toner supply and toward the latent image by an electrostatic field related to the latent image, thereby forming a toner image on the imaging member. The toner image is subsequently transferred to a physical media, such as a copy sheet. The copy sheet, having the toner image thereon, is then advanced to a fusing station for permanently affixing the toner image to the copy sheet.

The approach utilized for multi-color electrophotographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color complimentary thereto and the process is repeated for differently colored images with the respective toner of complimentary color. Thereafter, each color toner image can be transferred to the copy sheet in superimposed registration with the other toner images, creating, for example, a multi-layered toner image on the copy sheet. This multi-layer toner image is permanently affixed to the copy sheet in substantially conventional manner to form a finished copy.

An image to be rendered (an input image) is received in the form of, or is transformed into the form of, a set of contone values. For example, each contone can have a value ranging from 0 to 255 (in eight bit systems) or from 0 to 4095 (in higher resolution twelve bit systems). The contone values are indicative of how much colorant should be applied to the output medium in order to render a small portion of the image. For example, zero may indicate that no colorant should be applied to a small portion of the medium and a contone value of 255 may indicate that the entire area associated with a halftone cell should be covered with toner. Often, an ideal relationship between contone values and the amount of colorant applied to the medium is a linear one.

That is, typically an ideal or target tone reproduction curve (TRC), which relates input contone values to, for example, colorant density applied to the print medium, relates each possible contone value to a unique and incrementally proportional amount of colorant.

Some electrophotographic systems include a hierarchical control scheme in an attempt to provide an actual tone reproduction curve (TRC) that is as close as possible to the ideal or target tone reproduction curve (TRC). For example, some electrophotographic systems include what are referred to as level 1 control loops for maintaining electrophotographic actuators at associated set points, level 2 control loops for selecting set points for the level 1 control loops, and level 3 controls for compensating for residual differences or errors between the actual TRC and the target TRC in spite of the efforts of the level 2 control loops.

Xerographic actuators include, for example, cleaning field strength or voltage, development field strength or voltage, imager or laser power, and AC wire voltage associated with some developers. For example, in some xerographic environments level 1 control loops include electrostatic voltmeters (ESV) for measuring charge voltage generated by charge applied to a photoconductive member. For instance, the ESV measure the charge applied in the area of test patches in inter document or inter page zones (IPZ) of the photoconductor. If measured voltages, such as, for example, a discharged area voltage, or a cleaning voltage of an area surrounding a discharged area deviate from set point values, level 1 control loops adjust xerographic actuators to return the measured voltages to set point potentials. For example, the level 1 control loops vary a charge or bias voltage applied to elements of a developer to adjust a resulting development field and/or cleaning filed. Additionally, the level 1 control loops may adjust a laser power to return a related discharge field back toward a discharge field set point.

Level 2 control loops include, for example, infrared densitometers (IRD). In xerographic environments, and perhaps in other electrophotographic environments, infrared densitometers are also known as Enhanced Toner Area Coverage Sensors (ETACS). The infrared densitometers or ETACS are used to measure, for example, the density of toner or colorant applied to or developed on the photoconductive member. For instance, a set of test patches is written in an interdocument or interpage zone on the photoconductor. The test patches are developed and the amount or density of colorant or toner present in the test patches is measured. If the amount of colorant or toner in a test patch is incorrect or varies from a target test patch density, the level 2 control loops generate or select one or more new set points for the xerographic actuators of the level 1 control loops.

For instance, if a high-density test patch, such as a test patch corresponding to a target density of 100 percent (e.g., contone value 255), includes too little colorant or toner (is less dense than the target density), then the level 2 control loop may increase a set point related to the generation of a development field.

If the measured or actual density of a low-density test patch, or a test patch associated with a low-target density, such as, for example, 10 percent (e.g., a contone value of 25 or 26), includes more colorant or toner than is indicated by the associated target density, the level 2 controls may select or determine a new set point for a level 1 control loop associated with controlling a cleaning field voltage. For instance, increasing the cleaning field may reduce a toner density measured in a next low-density test patch.

If an infrared densitometer measures a deviation from a midrange target density in an associated test patch, the level 2 controls may select or determine a new set point for a level 1 controller responsible for regulating laser power.

The level 2 control loops strive to maintain the actual densities of test patches at desired or target levels. The assumption is that by adjusting the level 1 actuator set points to maintain the densities of a few test patches at target levels, an entire actual TRC will be maintained at or near an ideal or target TRC.

However, due to environmental and system changes, such as, for example, temperature, humidity, system age, wear, thermal expansion and contraction, toner quality and toner sources, the actual TRC of a system can become nonlinear. Therefore, anchoring an actual TRC to an ideal or target TRC at a few points, such as the high, low and midrange target densities described above, does not always maintain the entire actual TRC at ideal or target levels.

For example, referring to FIG. 1, even though the level 2 controls adjust level 1 set points in order to anchor an actual TRC 114 to a target TRC 118 at a high 122, low 126 and midrange 130 points on the target 118 TRC, the actual TRC 114 can meander away from the target TRC 118 in a first 134, second 138 and third 142 regions between the high 122 and midrange 130, midrange 130 and low 126, and low 126 and origin 146 points of the target 118 TRC, respectively.

Errors or deviations from the target TRC 118 of the actual reproduction curve 114 lead to errors in gray scale or color of images in output documents. For example, a portion of an input image is described in terms of the target or ideal TRC 118. The image portion is described as being associated with an input 150 contone value of 210. If the actual TRC 114 coincided perfectly with the target reproduction curve 118, then the input 150 contone value 210 would correspond to an output 154 contone value (and related toner density) of 210. However, due to temperature, humidity, system wear, variations in toner specifications and the like, the exemplary actual TRC 114 does not exactly coincide with the target TRC 118 and a residual error 158 exists between the actual TRC 114 and the target TRC 118. The error 158 in the actual TRC 114 causes a related gray scale or color error 162, and the input 150 contone value 210 results in a printed color or gray scale (toner density) 166 related to an ideal contone value of about 225.

Color errors caused by residual differences in actual TRCs and target TRCs, such as the one described above, are undesirable and can be unacceptable in some reprographic applications. Therefore, as mentioned above, some electrophotographic systems include a third level of control. Level 3 control loops may share the infrared densitometers of the level 2 control loops. Alternatively, level 3 control loops can include other sensors.

To implement level 3 control, a plurality of additional test patches are developed in inter page zones of an imaging member. The plurality of level 3 test patches is associated with a plurality of target level 3 test patch densities. The plurality of target level 3 test patch densities may or may not include the high 122, low 126 and midrange 130 target test patch densities described above. For instance, the plurality of target test patch densities includes test patch densities within the first 134, second 138 and third 142 regions of the actual and target TRCs 114, 118. Sensing the actual densities of the level 3 test patches associated with the plurality of target level 3 test patch densities provides the level 3 controllers with information about the actual TRC and, therefore, about the residual error within the regions 134, 138, 142 between the level 2 control points 122, 130, 126 and origin point 146. The level 3 controls use this information to build color correction lookup tables to be used in an image path of the system.

While color correcting lookup tables improve color accuracy, that improvement comes at the expense of a smoothness in color transition and a reduction in a number of available colors or shades. This loss can result in noticeable borders between regions in an image having slightly different color instead of smooth, blended transitions therebetween. The side effects of color correction lookup tables are referred to as banding and contouring.

Clearly, banding and contouring are undesirable. Therefore, there is a desire for a method that reduces the need for and/or the side effects of color correction lookup tables.

SUMMARY

The present invention contemplates a new and improved system and method which overcomes the above-referenced problems and others. One aspect of the invention is a method operative to control an electrophotographic system. The method comprising measuring an actual tone reproduction curve; comparing the actual tone reproduction curve to a target tone reproduction curve, and changing at least one point at which the actual tone reproduction curve is controlled to minimize error in the actual tone reproduction curve.

For example, changing at least one point at which the actual tone reproduction curve is controlled can include changing a target density of a control patch.

Changing a target density of a control patch can include changing a point along the actual tone reproduction curve at which the actual tone reproduction curve is anchored to the target tone reproduction curve by a control effort of a developability control loop.

One embodiment of the invention includes a method operative to minimize contouring in an electrophotographic system. The method can include selecting a target tone reproduction curve, selecting target level 2 default test patch densities, selecting target level 3 test patch densities for measuring an actual tone reproduction curve, developing level 2 default test patches based on the selected target level 2 default test patch densities, measuring actual level 2 test patch densities, determining a level 2 error between the actual level 2 test patch densities and the target level 2 default test patch densities, adjusting at least one level 2 actuator based on the determined level 2 error, developing level 3 default test patches based on the selected target level 3 default test patch densities, measuring actual level 3 test patch densities, determining a level 3 error between the actual level 3 test patch densities and the target level 3 test patch densities, determining a new target level 2 test patch density based on the determined level 3 error, developing the new level 2 test patch based on the new level 2 target test patch density, measuring a new actual level 2 test patch density, determining a new level 2 error between the new actual level 2 test patch density and the new target level 2 default test patch density, and adjusting the at least one level 2 actuator based on the determined new level 2 error.

Determining a level 3 error can include fitting a curve to the measured actual level 3 test patch densities and comparing the fitted curve to the target tone reproduction curve.

Determining a new level 2 target test patch density can include selecting a new level 2 target test patch density so as to reduce an area between a measured tone reproduction curve and an actual tone reproduction curve. Selecting a new level 2 target test patch can include attempting to make a first average area, between a first region of the actual tone reproduction curve and the target tone reproduction curve, equal to a second average area, between a second region of the actual tone reproduction curve and target tone reproduction curve. Additionally or alternatively, selecting a new level 2 target test patch can include attempting to make a third average area, between a third region of the actual tone reproduction curve and the target tone reproduction curve, equal to the second average area, between the second region of the actual tone reproduction curve and the target tone reproduction curve.

An embodiment of an electrophotographic operative to carry out the methods of the invention can include a level 1 control loop for maintaining a developability actuator at a developability actuator set point, a level 2 control loop for assigning a value to the developability set point based on a first set of system performance measurements, thereby providing a first order correction, and means for optimizing an aspect of the first set of system performance measurements, thereby minimizing an aspect of error in an actual tone reproduction curve.

Some embodiments of the electrophotographic system include a level 3 control loop for providing image path corrections based on a second set of system performance measurements, thereby providing a second order correction, the actions of the means for optimizing an aspect of the first set of system performance measurements being operative to minimizing the corrections provided by the level 3 control loop and/or side effects thereof.

For example, the level 1 control loop can include a development voltage control loop for maintaining a development voltage at a development voltage set point, a voltage control loop for maintaining a cleaning voltage at a cleaning voltage set point and/or a laser power control loop for maintaining a laser power at a laser power set point.

The level 2 control loop can include a colorant density control loop operative to adjust at least one of a bias voltage, a cleaning voltage, a laser power and a wire AC voltage, in order to maintain an actual colorant density at a target colorant density.

The level 3 control loop can include a colorant density control loop operative to adjust image contone values in order to maintain an actual colorant density at a target colorant density.

The means for optimizing an aspect of the first set of system performance measurements can include a means for selecting the target colorant density so as to reduce a control effort needed from the level 3 control loop. Alternatively or additionally, the means for optimizing an aspect of the first set of system performance measurements include a means for selecting the target colorant density so as to reduce a contouring effect resulting from control efforts of the level 3 control loop.

The first set of performance measurements can include a first set of measured control patch densities, the measured control patch densities being related to target control patch densities. The level 2 control loop can be directed toward aligning an actual tone reproduction curve with a target tone reproduction curve at at least points on the respective curves related to the target control patch densities. The means for optimizing an aspect of the first set of system performance measurements can include a processor and a procedure performed by the processor. The procedure can include comparing the target tone reproduction curve to a measurement of the actual tone reproduction curve, determining a sign of a desirable change in at least one target control patch density based on the comparison of the target tone reproduction curve and the actual tone reproduction curve, determining a magnitude of the desirable change in the at least one target control patch density based on the comparison of the target tone reproduction curve and the actual tone reproduction curve, and changing the at least one target control patch density based on the determined sign and the determined magnitude.

In some embodiments the level 1 controller is operative to maintain a xerographic actuator at a developability actuator set point.

BRIEF DESCRIPTION OF THE DRAWINGS

The invention may take form in various components and arrangements of components, and in various procedures and arrangements of procedures. The drawings are not to scale and are only for purposes of illustrating preferred embodiments and are not to be construed as limiting the invention.

FIG. 3 is a portion of a color correction lookup table that might be applied in an image path to compensate for the deviation shown in FIG. 2.

FIG. 8 is a comparison between the portion of the color correction lookup table of FIG. 3 and a similar portion of a new color correction lookup table compensating for the reduced error or deviation of FIG. 5.

DETAILED DESCRIPTION

Reference is now made to the drawings wherein the showings are made for purposes of illustrating preferred embodiments of the invention only and not for limiting the same.

Figure 1:
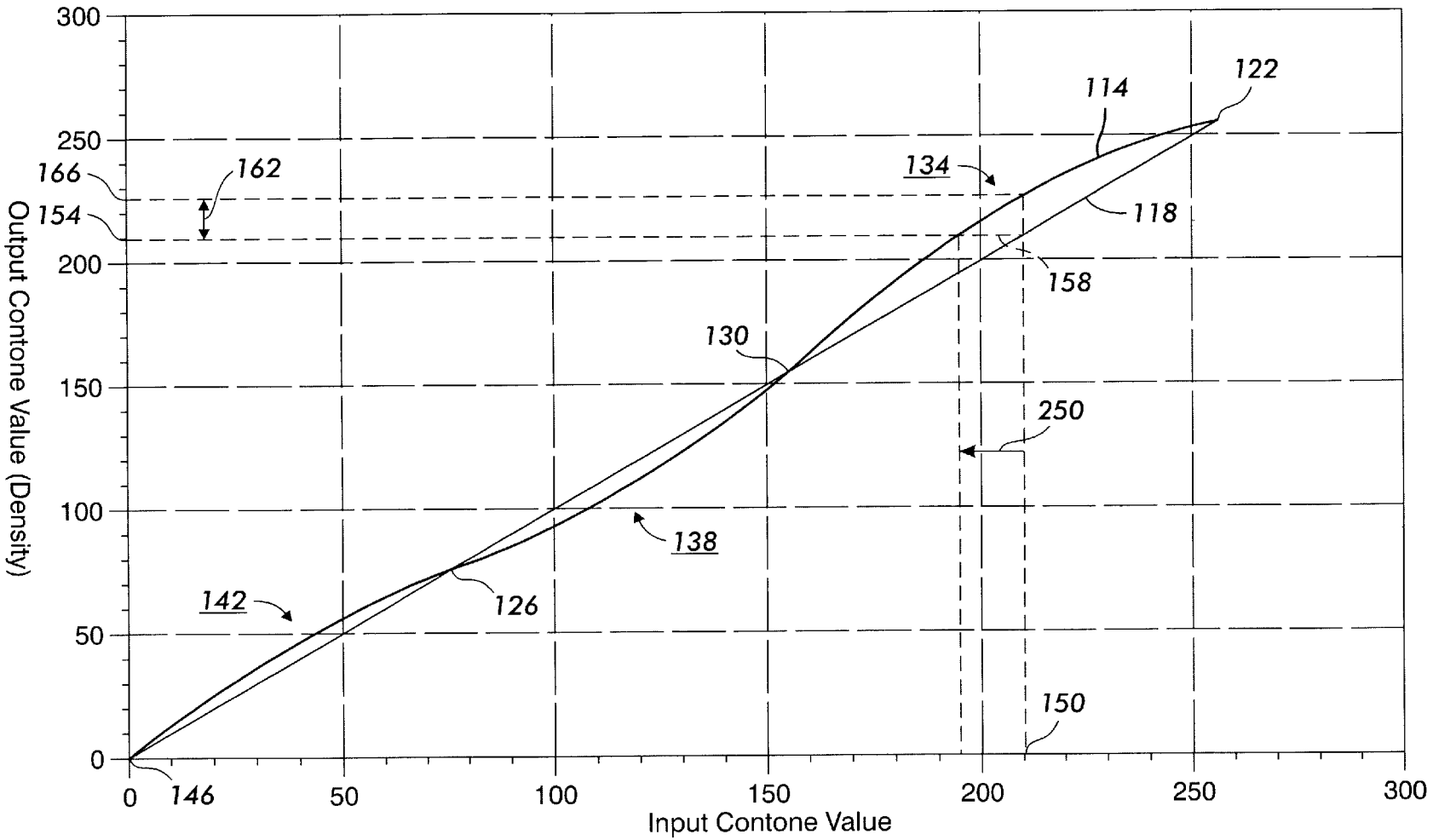
FIG. 1 is a graph comparing a target tone reproduction curve to an actual tone reproduction curve wherein default target densities are used as level 2 control points.
Figure 2:
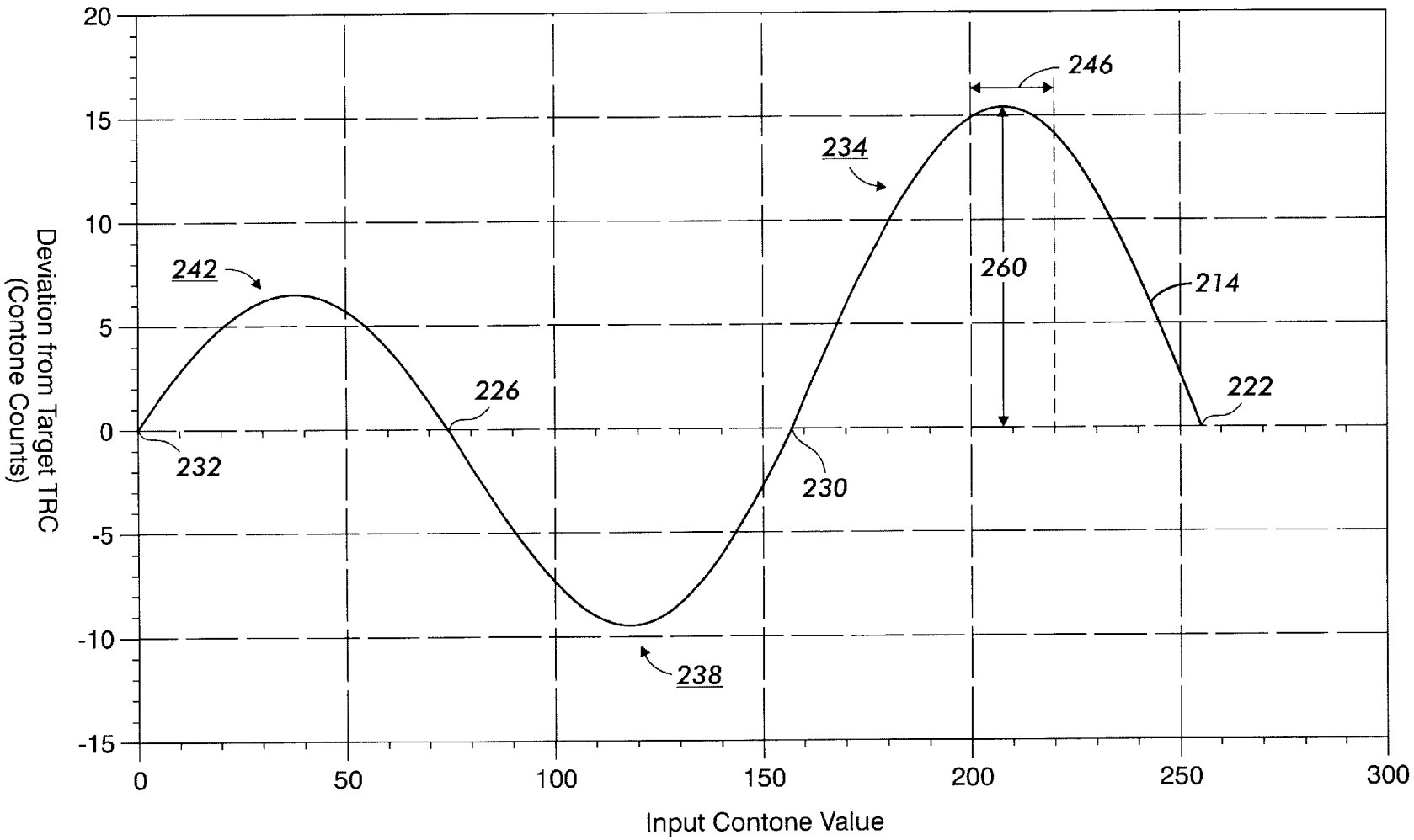
FIG. 2 is a graph of deviation of the actual tone reproduction curve from the target tone reproduction curve of FIG. 1.

Referring to FIG. 2, an exemplary deviation curve 214 shows the error or deviation of the actual TRC 114 from the target TRC 118 of FIG. 1. For example, the deviation curve shows a maximum deviation magnitude 260 of about 15.5 contone counts. In other words, the curve indicates that in the exemplary system, the density of toner or other colorant applied to a photoreceptor or other imaging member in response to an input contone value of 210 is 15.5 counts more than the amount desired or expected.

As indicated above in reference to FIG. 1, modem electrophotographic systems attempt to limit the deviation of an actual TRC from a target TRC by anchoring or controlling the actual TRC to the desired or target curve at small number of points. For example, level 2 controls limit a deviation curve of an electrophotographic system by measuring colorant or toner density of level 2 test patches developed in response or relation to these target level 2 test patch densities. For instance, densities are measured and controlled at a high 222, low 226, and midrange 230 points on the TRC. Since output densities are measured and actively controlled at the high, low and midrange points 222, 226, 230, (as explained in reference to the high, low and midrange points 122, 126, 130 of FIG. 1) the density deviation from the target TRC is very near zero at these points 222, 226, 230. Additionally, since no toner or colorant is applied for an input at the origin of a TRC, the error or deviation at an origin 232 of the deviation curve 214 is zero. As explained above, while the deviation curve 214 is anchored near zero at the high 222, low 226, midrange 230 and origin 232 points, the deviation curve 214 can meander away from the target (zero) in first 234, second 238 and third 242 regions between the high 222 and mid 230, mid 230 and low 226, and low 226 and origin 232 control points, respectively.

The location of the high, low and midrange 222, 226, 230 level 2 control points can be is determined by the electrophotographic system developer. For instance, through design, calculation, or experimentation, optimum level 2 control points are determined. It is assumed that all production systems behave in a similar manner and that level 2 control points optimally determined for a prototype or laboratory system will work equally well in all production units.

For instance, the high, low and midrange 222, 226, 230 control points are selected at a factory to be at contone values or target level 2 test patch densities of 255, 75 and 157 contone counts, respectively. With those level 2 control points, a system characterized by the deviation curve 214 of FIG. 2 is exhibiting a deviation from the ideal TRC of about 15 or more contone counts at a range 246 of input contone values of 200–215. This means, for example, when an input image includes a contone value such as, for example, 210, the amount of colorant deposited or developed on the imaging member or photoreceptor is inaccurate. Instead of corresponding to a contone count of 210, the amount of toner developed on the imaging member corresponds to a contone value of 225.5. In this case, there is a density error of 15.5. Referring to FIG. 1, it is noted that if the input contone value were modified or shifted 250 to, for example, 195, the resulting developed toner density would correspond to a contone value of about 210.

It is this ability to shift contone values to arrive at the desired output density that level 3 controls take advantage of. Additional target densities are selected (level 3 target densities) and additional control patches are developed (level 3 test patches) in association with those additional target control patch densities. The actual densities of the additional control patches are measured. For example, the additional target control patch densities are selected to be within the ranges 134, 138, 142 (234, 238, 242) between the level 2 control patch densities 122, 130, 126 (222, 230, 226) and origin point 146 (232). Curve fitting techniques are applied to measured data related to the additional test patches (and optionally the level 2 control patches). The curve fitting techniques provide an approximation for the actual TRC 114 or actual deviation curve 214. Once the actual TRC 114 or deviation curve 214 is known, a compensating color correction lookup table can be generated for shifting input contone values to corrected values.

For example, referring to FIG. 3, a portion 310 of a color correction-lookup table provides color corrected contone values for input contone values ranging from 150 to 255. Of course, a complete color correction lookup table would provide color corrected contone values for input contone values ranging from 0 to 255 (or what ever range of contone value is used by the system). The partial lookup table 310 is shown for simplicity and clarity's sake. The partial lookup table 310 includes an input column 314 and an output column 318. For example, in an electrophotographic system characterized by the relationship between the actual TRC 114 and target TRC 118 or by the deviation or error curve 214 image data calling for contone value of 150 is replaced with output or corrected image data from the lookup table 130 calling for a contone value of 153. The contone value of 150 was determined in preparing the image under the assumption that the actual TRC of the electrophotographic system was the same as the target or ideal TRC 118. However, since the actual TRC 114 is not the same as the target or ideal TRC 118, a shift or correction in contone value is required.

Similarly, the color correction lookup table indicates that an input contone value of 151 should be replaced with a corrected contone value of 154. An input contone value of 152 is also shifted or transformed to a corrected contone value of 154. Such a mapping of more than one input contone value (e.g., 151 and 152) to a single corrected contone value (e.g., 154) represents a first undesirable side effect of the use of color correction lookup tables. Each time two or more input contone values is mapped or transformed to a single corrected contone value, the color or shading gamut of the electrophotographic system is reduced. Two shades (151, 152) are replaced by one (154). In the partial lookup table 310, two input contone values are mapped to a single corrected contone value eighteen times. Each occurrence 322 represents a loss of a shade or color.

A second undesirable side effect of the use of color correcting lookup tables is called contouring or banding. It is caused when two or more consecutive input contone values map or are transformed to two non-consecutive corrected contone values. For example, in the partial lookup table 310, input contone value 218 maps to corrected contone value 203 and input contone value 219 maps to corrected contone value 205. There is no input contone value that maps to a corrected contone value of 204. The jump 326 in contone values from 203 to 205 represents a loss of smoothness. Where the partial 310 color correcting lookup table is applied, an image that includes a portion that smoothly transitions from a contone value of 218 to 219 will be rendered with a somewhat more noticeable change in shade. Jumps 330, similar to the jump 326 between 203 and 205, occur fourteen times in the partial lookup table 310 for a total of fifteen jumps 326, 330.

It should be noted that the partial lookup table 310 is exemplary only and includes only subtle examples of the described side effects. It is possible that the relationship between an actual TRC and a target TRC is such that the occurrences 322 of a plurality of input contone values mapping to a single corrected contone value are more severe. For example, three or more input contone values can map to a single corrected contone value. Additionally, jumps 330 can also be more severe. For example, two sequential input contone values can map to corrected contone values that are separated by two, three, four, five or more contone counts.

A method operative to minimize the severity of jumps 326, 330, the severity of occurrences 322 of a plurality of input contone values mapping to a single corrected contone value, and/or the number of times such artifacts 322, 326, 330 occur in a color correction lookup table of an electrophotgraphic system is based on the realization that the assumptions that all production systems behave in a similar manner and that level 2 control points determined to be optimal for a prototype or laboratory system will work equally well in all production units can be incorrect. The method includes dynamically selecting the points at which level 2 control loops control or anchor an actual TRC to a desired or target TRC.

Figure 4:
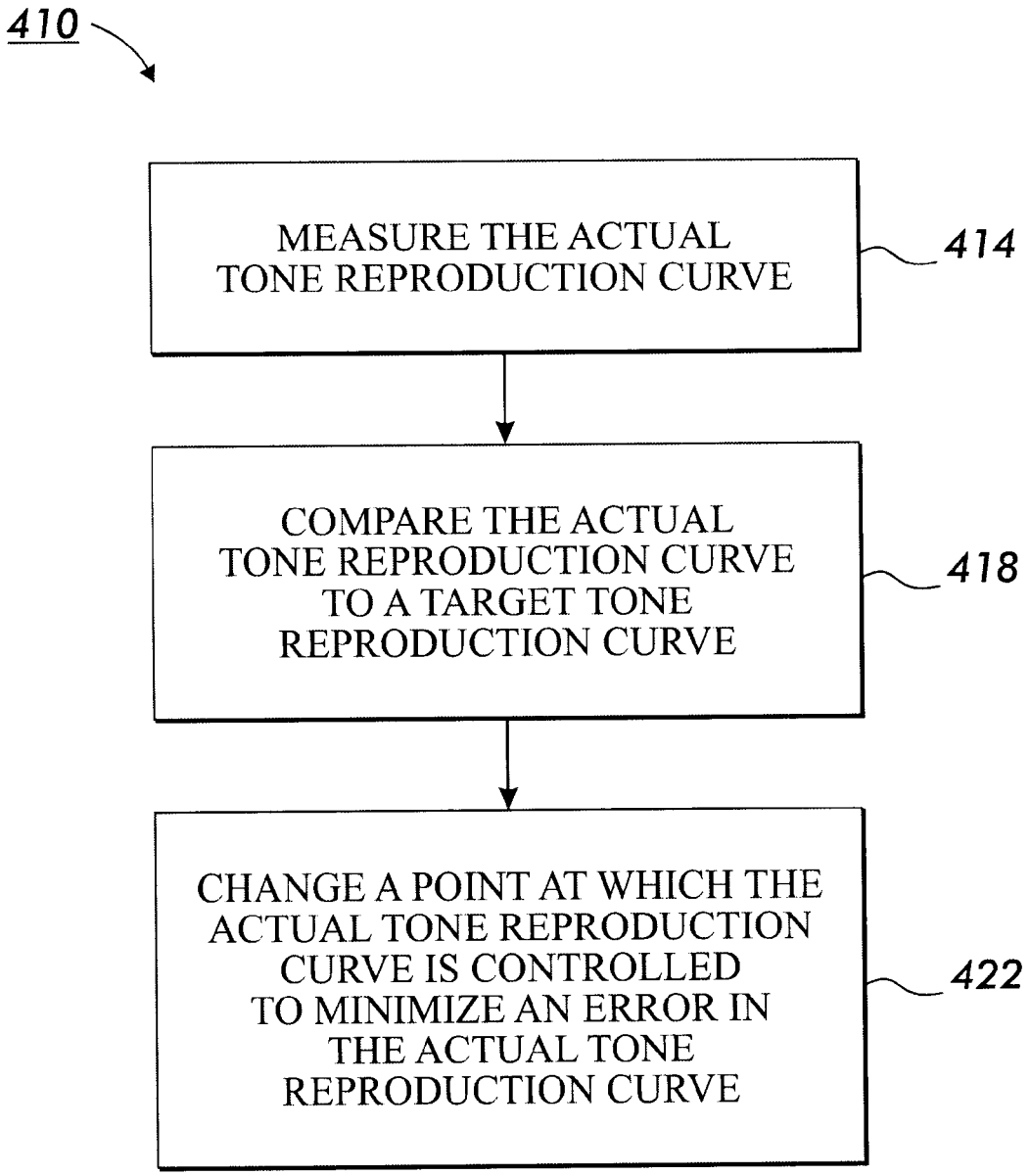
FIG. 4 is a flow chart of a method for controlling an electrophotographic system wherein an aspect of the error or deviation depicted in FIG. 2 may be controlled or minimized.

For example, referring to FIG. 4, a method 410 operative to control an electrophotographic system includes measuring 414 an actual TRC of the electrophotographic system, comparing 418 the actual TRC to a target TRC and, changing at least one point at which the actual TRC is controlled in order minimize error in the actual TRC.

As mentioned above, in prior art systems, level 2 control points (e.g., 222, 226, 230) are determined by an electrophotographic system producer through design, calculation or experimentation. For instance, once the level 2 control points are selected or determined, they are made the same for each unit produced of a particular electrophotographic system model, and for each unit, the control points are the same throughout its operational lifetime. However, due to variations related to production tolerances, environmental factors, wear and system age, level 2 control points selected or determined at a production facility might not be optimum for each unit produced or at any given time for any given unit.

For example, if an actual TRC is associated with a deviation curve that has a relatively large amplitude in a particular region, it may be beneficial to move a level 2 control point or target control patch density toward that region. For instance, an amplitude 260 of the first region 234 of the deviation curve 214 may be reduced by moving the midrange control point 230 toward the high end control point 222, thereby reducing the size of the first region 234 and applying control closer to points in the actual TRC that are tending to deviate from the target reproduction curve.

Figure 5:
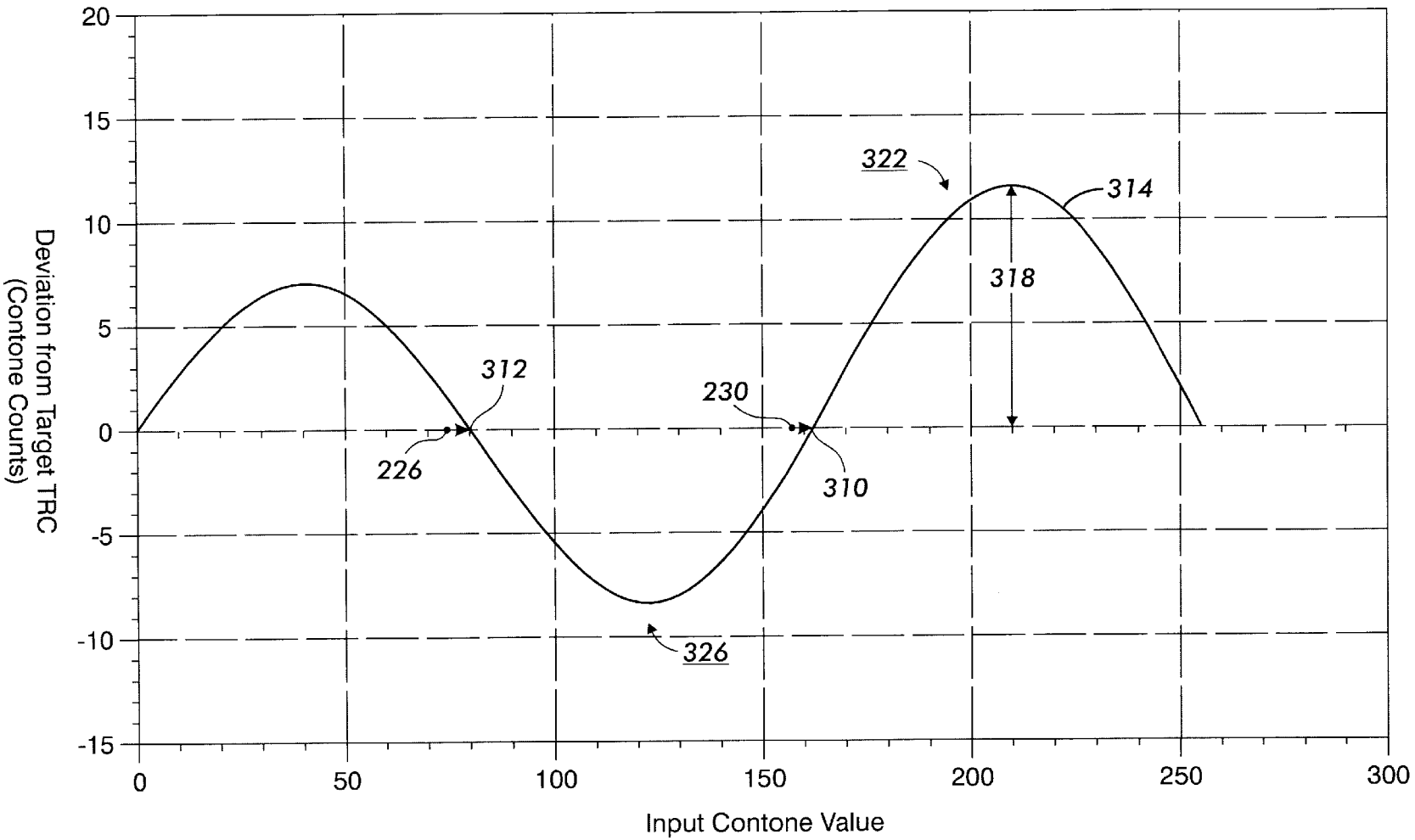
FIG. 5 is a graph of a deviation curve showing the benefits of the application of the method of FIG. 4.

For instance, referring to FIG. 5, changing midrange 230 level 2 control point to a new midrange 310 level 2 control point and the low end 226 level 2 control point to a new low end 312 level 2 control point effectively reduces error and produces a new deviation curve 314. For instance, the first region 234 amplitude 260 was about 15.5. A new amplitude 318 of a new first region 322 created by shifting the midrange control point 230 to the new midrange control point 310 is about 15.5.

The method 410 operative to control an electrophotographic system provides for the dynamic selection, and thereby optimization, of level 2 control points. Measuring 414 the actual TRC provides a basis for selecting or changing one or more level 2 control points. For example, the actual TRC is measured at evenly distributed points along the TRC. For instance, target densities associated with contone values of 25, 50, 75, 100 . . . 175, 200, 225 and 250 are selected. Test patches associated with those target densities are developed in an inter page zone on an imaging member and are measured, for example, with ETAC sensors or other mass or density sensors. Alternatively, the actual tone reproduction curve is sampled more heavily in a portion deemed to be more important for a particular image-rendering application. For instance, where highlights are more important than shadows, that portion of the actual TRC associated with highlight shades or colors is sampled at more points than is a shadow region.

While it is possible to sample the actual TRC at each contone level, thereby collecting data regarding an exact reproduction curve, producing and measuring such a relatively large number of test patches may be impractical. For example, the amount of colorant or toner consumed in such a process and/or the amount of time required to produce and sample that many patches may be prohibitive. Therefore, the actual TRC is measured at a relatively small number of points along the curve. Curve fitting techniques are applied to estimate values for the unmeasured portions of the actual TRC or an associated deviation curve. For example, spline fit, weighted basis functions, or sine functions and related techniques are used to generate an approximation for the actual TRC.

Comparing 418 the actual TRC to a target TRC can include, for example, subtracting the target TRC from the actual TRC to generate a deviation curve. For example, an area is measured between the deviation curve 214 and the zero-deviation line, or axis, in each of the uncontrolled regions 234, 238, 242. These regional area measurements are weighted by the number of contone values associated with each region. These weighted or average areas are compared to each other and a decision is made as to how to change 422 the level 2 control points 222, 226, 230 in order to better distribute or otherwise improve or minimize the error between the actual TRC and the target TRC.

It should be noted that, while in the illustrated examples, the target TRC is a straight line, other target TRCs are contemplated. For example, level 4 controls may adjust the target TRC on a dynamic basis. For instance, spectrophotometers may measure colors rendered on a print medium such as paper. On the basis of those measurements, it may be determined that the target TRC should be adjusted.

In some embodiments, changing 422 the points 222, 226, 230 at which the actual TRC is controlled is done on the basis of evenly distributing error or average error over the length of the actual TRC. This can be done an iterative basis. For example, an integration of the deviation curve is performed from the midrange point 230 to the high-end point 222. The result of that calculation is divided by the number of levels or contone counts between those points (230, 222). A similar integration is done between the low point 226 and the midrange point 230. The results of those two calculations are compared. If they are equal, the midrange point 230 is well positioned, and no change is made. If, however, one average error is larger than the other, then the midrange level 2 control point is shifted toward the region (234 or 238) associated with the larger average error. The magnitude of the shift can be based on the magnitude of the difference in average errors. Alternatively, the magnitude of the shift is a standard small increment. A similar comparison can be made between average errors associated with the second region 238 and the third region 242. For example, the average errors associated with the second 238 and first 242 regions can be calculated after shifting the midrange 230 control point to a new midrange control point 310 and after the level 2 controls have established control of the actual TRC at the new midrange control point 310. For instance, after control is reestablished at the new midpoint 310, the actual TRC can be re-measured. The new second region can be compared with the third region 242. If there is a difference in the average errors or areas the low-end control point 226 can be shifted toward the region having the larger error. For example, the low-end control point 226 can be shifted to a new low-end control point 312. Again, the magnitude of the shift can be based on the magnitude of the difference in the average errors or areas of the second and first regions. Alternatively, the magnitude of the shift can be based on the standard small increment.

Alternatively, appropriate shifts for the level 2 control points 222, 230, 226 might be calculated or predicted based on an analysis of the first measurement of the actual TRC 114 or deviation curve 214 and made simultaneously.

Of course, the new control points (e.g., 310, 312) can be shifted again if future measurements 414 and comparisons 418 indicate that such shifting is warranted.

As will be illustrated by example below, controlling or distributing an error between an actual TRC and a target TRC can reduce a magnitude of adjustments made to contone values by color correcting lookup tables. Additionally, such error control can reduce a number of contone values that need to be adjusted. Furthermore, controlling the error appropriately can reduce the number of occurrences 322 of mapping a plurality of input values to a single corrected contone value and reduce the number of jumps 330 associated with consecutive input contone values in the color correcting lookup table.

Figure 6:
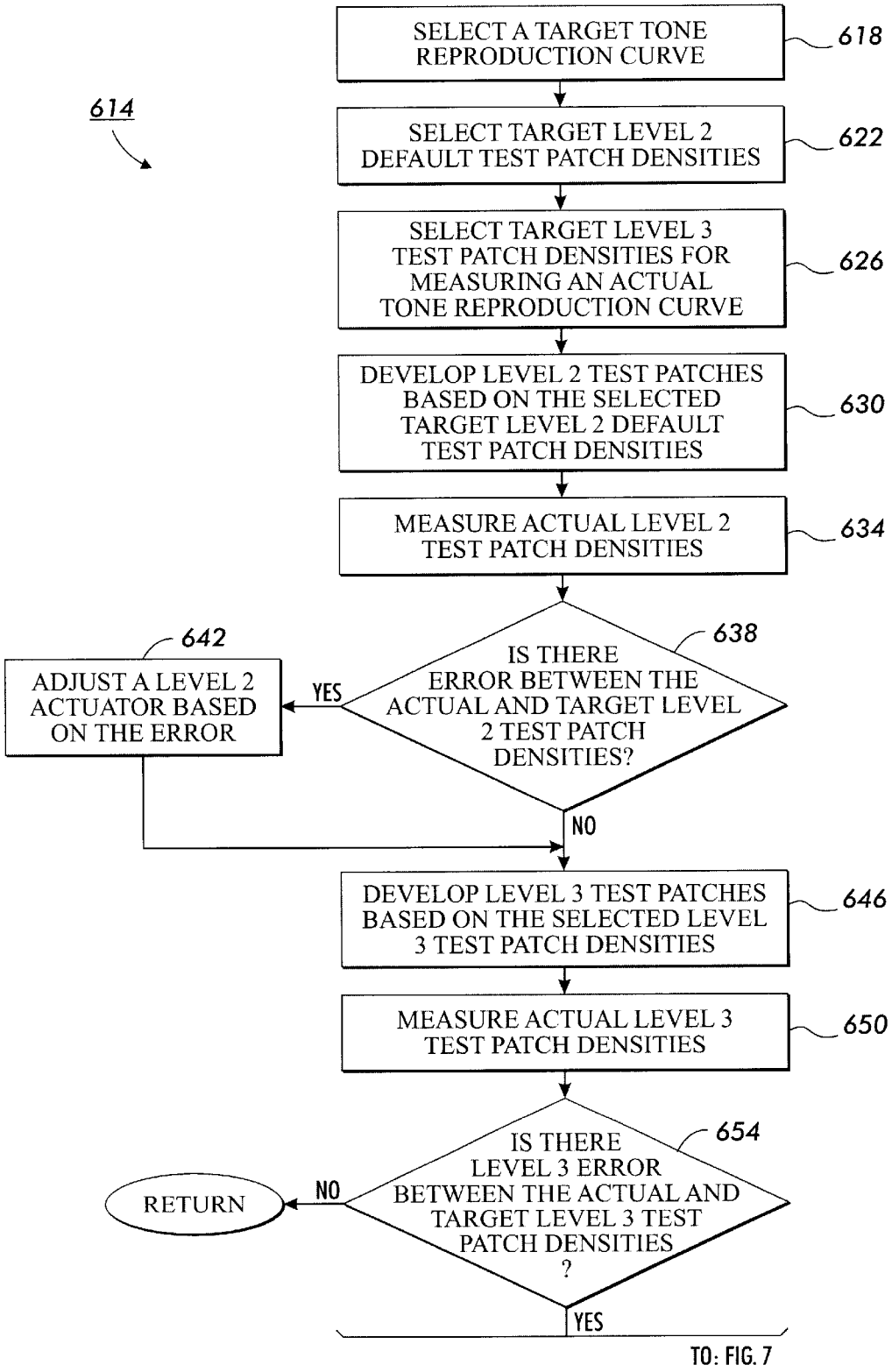
FIG. 6 and FIG. 7 are respective portions of a flow chart of an embodiment of the method of FIG. 4.
Figure 7:
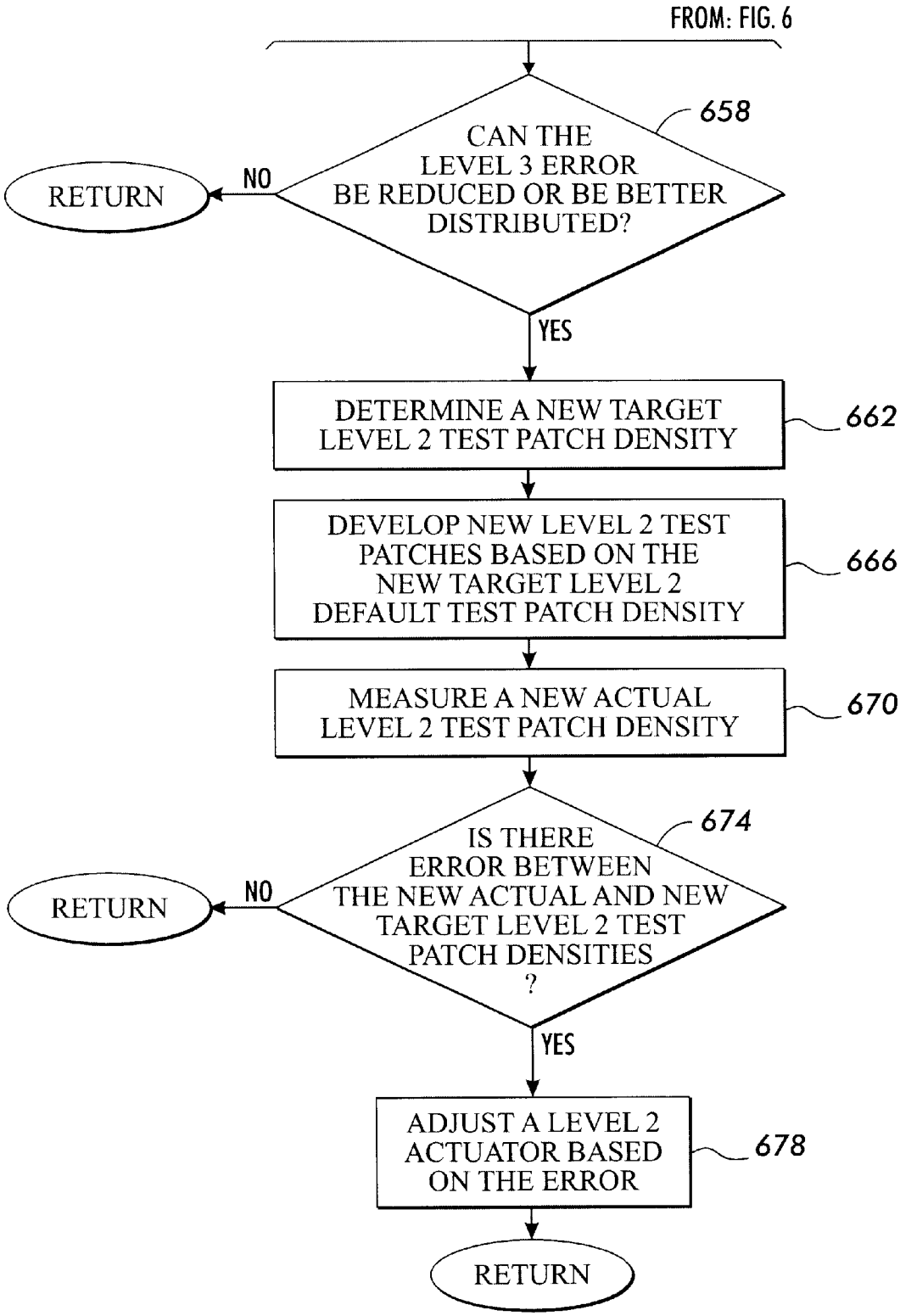

Referring to FIG. 6 and FIG. 7, one embodiment of the method 414 operative to control an electrophotographic system is a method 614 operative to minimize contouring in an electrophotographic system. The method includes selecting 618 a target TRC, selecting 622 target level 2 default test patch densities, selecting 626 target level 3 test patch densities, developing 630 level 2 test patches based on the selected target level 2 default test patch densities, measuring 634 actual level 2 test patch densities, determining 638 an error between the actual and target level 2 test patch densities, if there is an error, adjusting 642 a level 2 actuator based on the error, developing 646 level 3 test patches based on the selected level 3 test patch densities, measuring 650 actual level 3 test patch densities, determining 654 if there is a level 3 or residual error between the actual and target level 3 test patch densities and determining 658 if such an error can be reduced or better distributed. If a level 3 error can be reduced or better distributed, determining 662 a new target level test patch density, developing 666 new level 2 test patches based on the new target level 2 default test patch densities, measuring 670 a new actual level 2 test patch density, and if there is error 674 between the new actual and new target level 2 test patch density, adjusting 678 a level 2 actuator based on the new error.

Selecting 618 a target TRC can include, for example, selecting a default target TRC such as, for example, the linear target TRC 118 depicted in FIG. 1. Alternatively, a target TRC may be selected or adjusted, for example, by a level 4 control loop.

Selecting 622 target level 2 default test patch densities can include selecting test patch densities found to be optimum at design time or in laboratory experiments. For example, an electrophotographic system manufacturer may load in default test patch densities during manufacturing.

Similarly, selecting 626 target level 3 test patch densities can be done at manufacturing. For example, target level 3 test patch densities may be evenly distributed along a TRC. Alternatively, target level 3 test patch densities can be selected on a job-by-job basis, taking into account color or shading content of a job image and, therefore, important portions of the TRCs.

Developing 630 level 2 test patches based on the selected target level 2 default test patch densities includes, for example, generating a latent image on an imaging member and attracting or driving colorant or toner toward the latent image. For instance, in xerographic applications, a substantially uniform charge is applied to a portion of a photoreceptor. Portions of this charged area are then discharged through exposure to light. For example, light from a laser or light-emitting diode is scanned across the area. The light is modulated on and off while being scanned across the area. Light discharges the photoreceptor; therefore, portions of the area remain charged while other portions are discharged. Depending on the technology, either the charged area or the discharged area attracts toner. For example, in scavengeless development systems, toner is attracted to or urged toward discharged portions of the imaging member. This is referred to as discharged area development (DAD). In this case, the portions of the imaging member that remain charged provide a cleaning field urging toner or other colorant away from those portions of the imaging member or photoreceptor. For a more detailed description of scavengeless development systems, reference may be made to U.S. Pat. No. 5,144,371 granted to Dan Hayes on Sep. 1, 1992.

Measuring 634 actual level 2 test patch densities includes, for example, using an infrared densitometer or ETAC sensor to measure the reflectance of the imaging member and colorant or toner in an area of the test patches. Determining 638 an error between the actual and target level 2 test patch densities includes determining if there is any error, and if there is an error, determining its sign and magnitude. If there is an error, then a related level 2 actuator is adjusted 642 or actuated so as to reduce the error. For example, if a high-density test patch such as high-end test patch 222 includes too little colorant or toner, then a development field set point may be increased thereby urging more charged toner particles toward the imaging member. If the actual density of a low-density test patch, such as, for example, low-end test patch 226, includes more colorant or toner than is indicated by a related low-end target test patch density, then a cleaning field voltage set point is increased. If an infrared densitomer or ETAC sensor measures a deviation in the measured density of an actual level 2 midrange test patch such as the midrange test patch 230 of FIG. 2, a light source or laser power may be adjusted accordingly. Once the level 2 actuators are adjusted so that there is no significant error between the actual and target level 2 test patch densities, development 646 of the level 3 test patches is beneficially performed.

Developing 646 level 3 test patches is similar to developing 360 level 2 test patches. However, the level 3 test patches are developed based on the selected level 3 test patch densities. A purpose of the level 3 test patches is to measure residual error or error uncorrected by the level 2 controls. Therefore, the level 3 test patch densities are beneficially selected to be at points on the TRC other than those controlled by and selected for the level 2 test patch densities. That is, the level 3 test patch target densities are beneficially selected to be within, for example, the first 234, second 238 and third 242 regions between the level 2 control points and origin of the actual TRC or deviation curve (e.g., 214). Measuring 650 actual level 3 test patch densities is similar to measuring 634 actual level 2 test patch densities.

Determining a level 3 error between the actual level 3 test patch densities and target level 3 test patch densities includes determining 654 if there is significant level 3 error between the actual and target level 3 test patches and, if there is, determining 658 whether or not the level 3 error can be reduced or better distributed over the length of the TRC.

For instance, after the actual level 3 test patch measurements are made, curve fitting techniques are applied to the collected data to generate an approximation to the actual TRC. The approximated actual TRC is compared to the target TRC and some aspect of error between the curves is determined. For example, a difference, such as a maximum difference, a maximum percentage difference, or maximum percent of reading difference, is determined. Alternatively, one or more average errors between the approximated actual TRC and the target TRC is determined.

For example, if an average error is higher in a first region than in a second or third region, then the error can probably be better distributed. Alternatively, if a document image being processed only includes colors or shades from a certain portion of the TRC, then it might be beneficial to shift as much error as possible toward an unused portion of the TRC.

Therefore, determining 662 a new target level 2 test patch density can include considering aspects of a current print job. New target level 2 test patch densities can be selected as described in reference to FIG. 5 so that the average error in each region 322, 326, 330 of the deviation curve is the same. Alternatively, for example, both the low-312 and midrange 310 new target level 2 test patch densities can be placed within an important portion of the TRC, where the important portion of the TRC is determined on a job-by-job or sheet-by-sheet basis. As described above, the target level 2 test patch densities can be determined 662 through iteration or based on analytical methods. Once new target level test patch densities are determine 662, developing 666 new level 2 test patches, measuring 670 the new actual level 2 test patch, determining 674 new error between the new actual and new target level 2 test patch densities and adjusting 678 a level 2 actuator based on any new error are very similar to the developing 630, measuring 634, determining 638 and adjusting 642 elements described above.

The method 410 operative to control an electrophotographic system is operative to control or minimize an error in an actual TRC. For example, the method 410 operative to control and electrophotographic system can be used to control or minimize a maximum deviation 260, 318 of a deviation curve 214, 314. Additionally, certain embodiments, such as the method 614 operative to minimize contouring in an electrophotographic system can be used to reduce the number or severity of occurrences 322 of pluralities of input contone values being mapped to single color corrected contone values in an image path color correction lookup table as well as the number and severity of jumps 330.

For example, referring to FIG. 8 a portion 810 of a new color correction lookup table can be compared to the similar portion 310 of the color correction lookup table described in reference to FIG. 3. The input contone values 314 of the portion 810 of the new color correction lookup table are the same as the input contone values 314 of the portion 310 of the previously described table. However, new color corrected contone values 818 are different than the color corrected contone values 318 of FIG. 3. For example, since the amplitude of the maximum deviation 260, 318 of the deviation curve 214, 314 has been reduced, the amplitude of correction provided by the portion 810 of the new color correction lookup table is also reduced. Additionally, a number of occurrences 822 of a plurality of input contone values 314 being mapped to a same new color corrected contone value has been reduced.

For instance, in the illustrated range of input contone values (150–255), the portion 310 of the color correcting lookup table of FIG. 3 included 18 occurrences 322 of a plurality of input contone values being mapped to a single corrected contone value. In the portion 810 of the new color corrected lookup table, there are only 16 such occurrences 822. This represents over an 11 percent improvement in color gamut loss. Similarly, in the same range of input contone values (150–255), the portion 310 of the color correction lookup table of FIG. 3 included 15 jumps (326, 330) in color corrected colors associated with consecutive input contone values. In contrast, the portion 810 of the new color corrected lookup table made possible by the application of the methods 410,610 described above includes only 12 such jumps 830. This represents a 20 percent reduction in banding or contouring. It should be noted that this comparison is exemplary only. Improvements made by the methods 410, 610 in other systems may be different.

Figure 9:
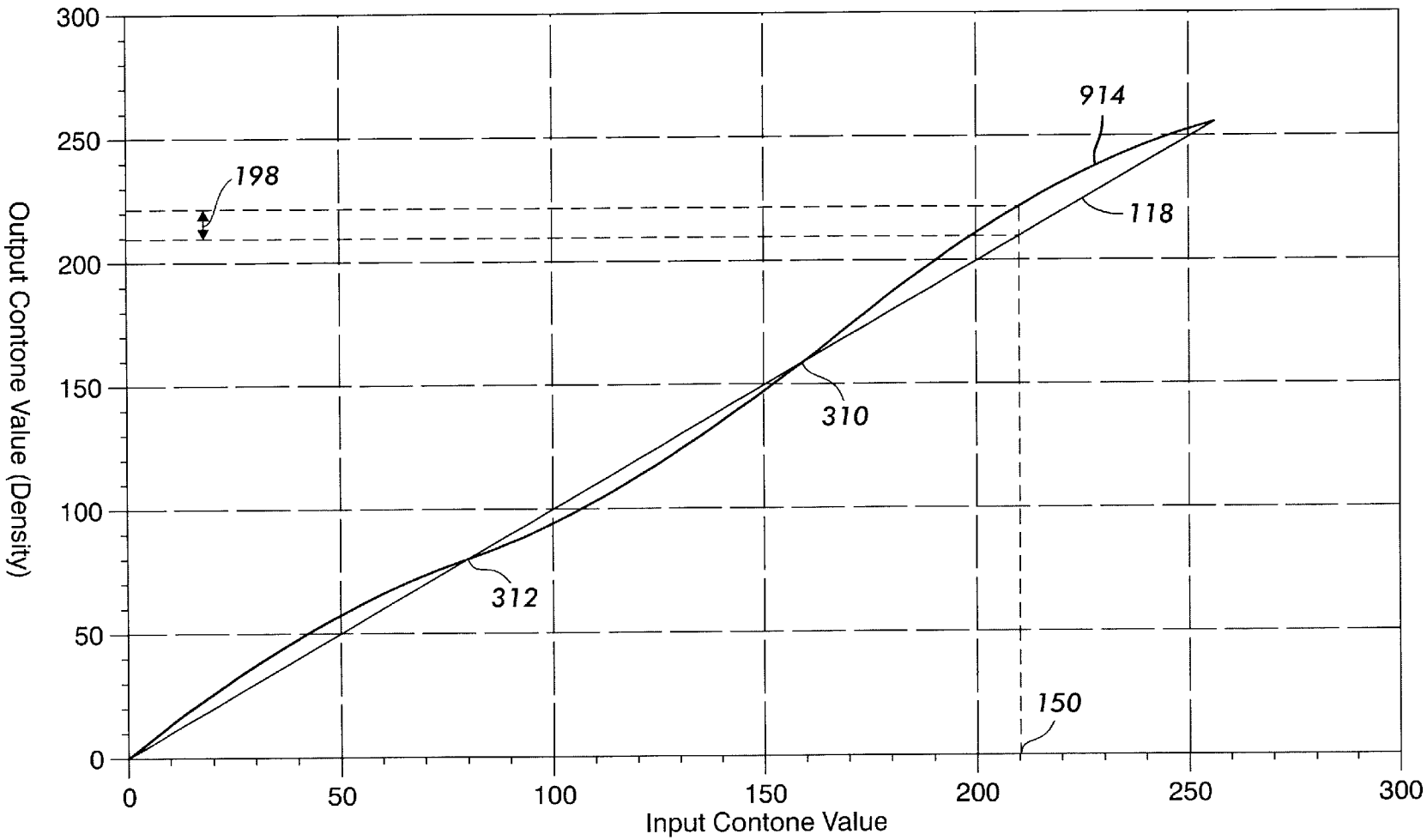
FIG. 9 is a graph comparing an actual tone reproduction curve to a target tone reproduction curve after the application of the method of FIG. 4.
Figure 10:
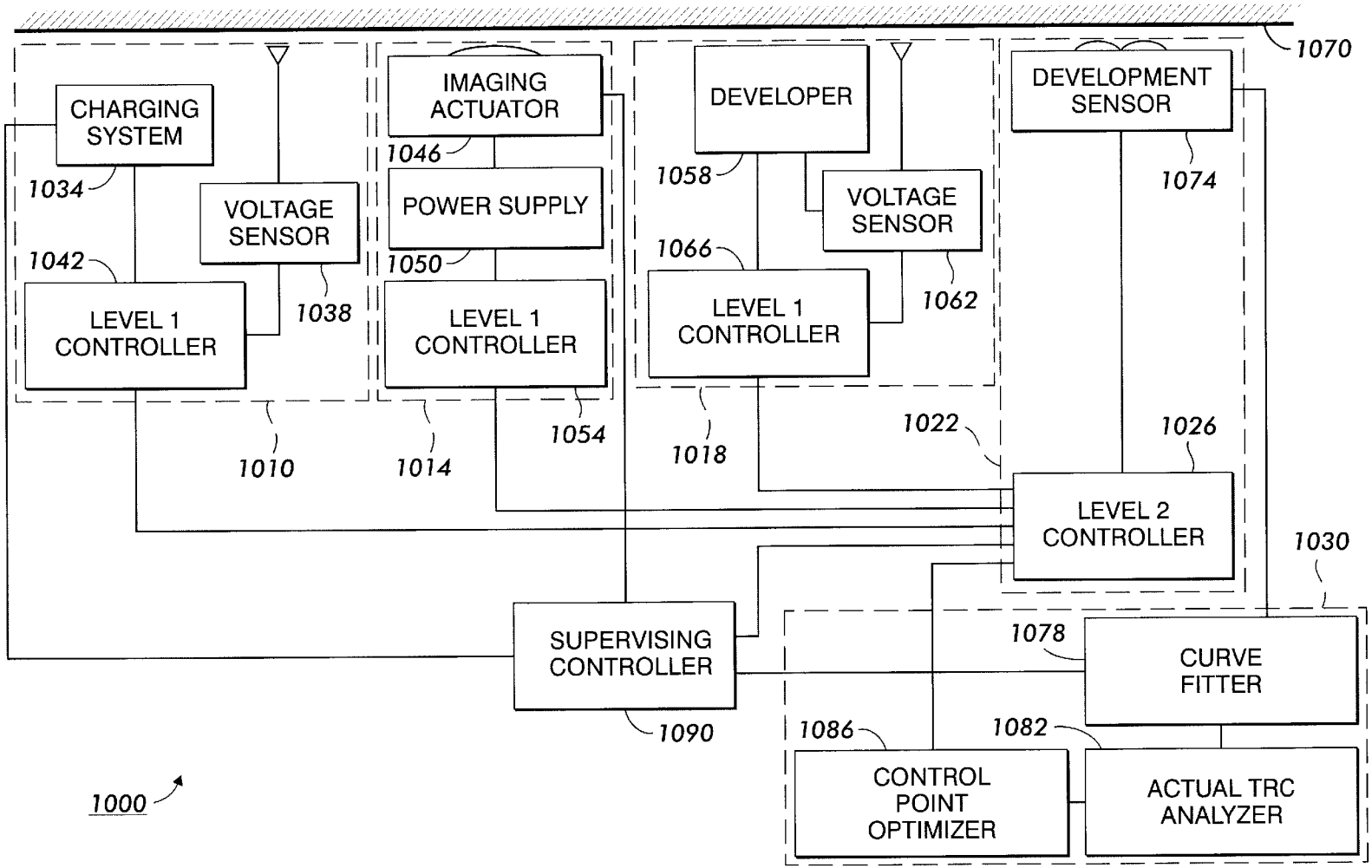
FIG. 10 is a block diagram of a system operative to perform the method of FIG. 4.

Benefits of the method 410 operative to control an electrophotographic system disclosed above can be realized even where color correcting lookup tables are not employed. For example, referring to FIG. 9, by shifting the low 226 and midrange 230 level 2 control points in the exemplary electrophotographic system from their original positions to their new positions 312, 310, an improved actual TRC 914 is achieved. For example, at the exemplary contone value 150 of 210, an error 918 in output toner density associated with error in the approved actual TRC 914 has a magnitude of about 11 contone counts. This compares favorably with the original output toner density error 162 which related to a contone count error of about 15.5 counts. This represents a more than 29 percent reduction in color or shade error at the exemplary color 150 of interest 210. Therefore, the method 410 can be used to improve electrophotographic system accuracy on its own or in conjunction with level 3 controls.

An exemplary electrophotographic system 1000 operative to perform the method 410 for controlling an electrophotocgraphic system includes a plurality of level 1 control loops 1010, 1014, 1018, and a level 2 control loop 1022 for assigning set points to the level 1 control loops, 1010, 1014, 1018. A level 2 controller 1026 of the level 2 control loop 1022 assigns values to the set points based on a first set of system performance measurements. The exemplary system 1000 also includes means 1030 for optimizing an aspect of the first set of system performance measurements.

For instance, the first level 1 control loop 1010 includes a charging system 1034, a voltage sensor 1038 and a first 1042 level 1 controller. The second level 1 control loop 1014 includes an imaging actuator 1046, a power supply 1050 and a second 1054 level 1 controller. The third 1018 level 1 control loop includes a developer 1058, a voltage sensor 1062 and a third 1066 level 1 controller.

The charging system 1034 is operative to place a charge on an imaging member 1070. For example, the charging system 1034 can include a coronal discharge device. Alternatively, the charging system 1034 can include a split recharge system wherein both a direct and alternating current charging device are used. The charging system 1034 can, for example, apply a charge to the imaging member 1070 for attracting or repelling colorant such as toner particles supplied by the developer 1058. Where the charging system 1034 applies charge for repelling colorant, the charging system 1034, the first level 1 control loop 1010 may be considered a cleaning voltage control loop.

The imaging actuator 1046 generates a latent image on the imaging member 1070. For example, the imaging actuator is a modulated laser or LED light source. Light from the imaging actuator is scanned across the charged surface provided by the charging system 1034. The light causes portions of the imaging member 1070 to become conductive, and those portions of the charged area provided by the charging system 1034 are at least partially discharged.

Alternatively, the imaging actuator 1046 provides a beam of charge carriers such as electrons. In that case, the imaging actuator 1046 includes the charging system 1034 and the functions of the charging system 1034 and imaging actuator 1046 are achieved simultaneously.

The voltage sensors 1038, 1062 can be, for example, an electrostatic voltage meters (ESV). The first voltage sensor 1038 provides a measure of the charge delivered by the charging system 1034 to the imaging member. The first voltage sensor 1038 delivers that measurement to the first 1042 level 1 controller. The level 1 controller adjusts the charging system as necessary to maintain the charge delivered by the charging system 1034 at a charge set point.

In the second 1014 level 1 control loop, the second 1054 level 1 controller monitors and adjusts the power supply 1050 of the imaging actuator. For example, the second 1054 level 1 controller maintains a voltage, a current, or a power level delivered to the imaging actuator 1054 by the power supply 1050 at a power supply set point. Where the imaging actuator is a laser, the second 1014 level 1 control loop may be considered a laser power control loop.

In the third 1018 level 1 control loop, the second voltage sensor 1062 measures a development field between the imaging member 1070 and an element of the developer. For example, a magnetic roll also carries a driving voltage relative to the imaging member 1070. Magnetic beads carry charged toner particles and are attracted to the magnetic roll. The magnetic beads form brushes on the magnetic roll. The voltage applied to the magnetic roll urges toner off the beads and toward the latent image produced by the imaging actuator 1046 on the imaging member 1070. The third 1066 level 1 controller monitors the voltage sensed by the voltage sensor 1062 and controls the developer to maintain the development field at a development field set point. In this regard, the third 1018 level 1 control loop may be considered a development voltage control loop.

Of course, the charging system 1034, imaging actuator 1046, and developer 1058 are directed toward producing images from print jobs. However, the methods 410, 610 described above are directed toward maintaining an image quality of the print job images by using and controlling the charging system 1034, imaging actuator 1046, and developer 1058 to produce test patches which are then sensed. Information from the sensing is then used to make adjustments to the control loops associated with the charging system 1034, imaging actuator 1046, and developer 1058 that will maintain a high quality of the print job images.

For example, the level 2 controller 1026 of the level 2 control loop 1022 receives development signals from a development sensor 1074. The development sensor 1074 can be, for example, an infrared densitometer (IRD) or enhanced toner area coverage sensor (ETACS). The development sensor 1074 provides a measurement of an amount of toner or toner density deposited on portions of the imaging member 1070. The level 2 controller 1026 compares measurements received from the development sensor 1074 to target densities. For example, the level 2 controller compares measured high 222, low 226 and midrange 230 test patch densities to high, low and midrange target level 2 test patch densities associated with the actual level 2 test patches. If the measured densities do not match the target densities, then the level 2 controller adjusts one or more level 1 set points so that subsequent test patches are produced at densities closer to their related target densities. The target densities are related to densities of a target TRC 118. Adjusting the level 1 set points urges an actual TRC 114 toward the target TRC 118. When the actual TRCs match or are close to the target TRCs, images produced by the electrophotographic system match or are close to target or desired images.

The means 1030 for optimizing an aspect of the first set of system performance measurements optimizes, for example, the selection of target densities of the level 2 controller. The means 1030 for optimizing an aspect of the first set of system performance measurements includes, for example, a curve fitter 1078, an actual TRC analyzer 1082 and a control point optimizer 1086. The curve fitter 1078 receives signals from the development sensor 1074. The signals are related to density measurements of a plurality of level 3 test patches. Target level 3 densities associated with the plurality of level 3 test patches are distributed, for example, throughout a range of produceable toner or colorant densities. The curve fitter 1078 applies curve-fitting techniques, such as, for example, spline fit, weighted basis functions, or sine functions, as appropriate to the sensor 1074 data to generate a fitted curve. The fitted curve provides a close approximation of the actual TRC from a relatively few test patch samples.

The actual TRC analyzer 1082 compares the actual TRC 114, 814 to the target TRC 118 to determine if error or deviation exists between the two curves. If deviation or error does exist, the actual TRC analyzer determines one or more measures of the error. For example, the actual TRC analyzer 1082 may determine a maximum error or deviation. Additionally, or alternatively, the actual TRC analyzer 1082 may determine an average error or an average error for a plurality of regions of the actual TRC. Furthermore, the actual TRC analyzer 1082 may determine a maximum slope, slopes, or first derivative of a deviation curve 214 associated with the actual TRC. For instance, the slopes or first derivative may be associated with the number of jumps 330 or number of occurrences 322 of a plurality of input contone values being associated with a single output contone value in a color correcting lookup table.

Whichever kind of error or errors, the actual TRC analyzer 1082 determines, the control point optimizer 1086 determines, controls, selects, or updates the target level 2 densities of the level 2 test patches the level 2 controller 1026 uses as control points. For example, the control point optimizer 1086 shifts the level 2 control points toward regions or points of high error and away from regions of low error thereby applying control effort where it is most needed along the actual TRC.

A supervising controller 1090 orchestrates the activities of the charging system 1034, imaging actuator 1046, level 2 controller 1026 and the means for optimizing 1030. For example, the supervising controller 1090 determines when it is appropriate to generate test patches and which test patches to generate. For instance, at appropriate times, the supervising controller 1090 supplies control signals to the charging system 1034 and imaging actuator to produce level 2 test patches according to the current level 2 target test patch densities. The charging system 1034 and imaging actuator work together to produce a latent image on the imaging member 1070. The developer 1058 provides a cloud or brush or other technique for applying toner to the latent image and urges toner toward the latent image via electrostatic forces. The development sensor 1074 senses the density or other measure, such as toner mass, associated with the accuracy of the development process. As explained above, the level 2 controller 1026 compares the measurement provided by the development sensor 1074 to the target densities or masses and adjusts the level 1 set points as necessary.

The supervising controller 1090 also orchestrates the production of additional test patches and activities of the means 1030 for optimizing an aspect of the first set of system performance measurements (e.g., target densities). For instance, the supervising controller 1090 directs the charging system 1034 and imaging actuator 1046 to produce a plurality of latent images associated with the plurality of target level 3 test patch densities for sampling the actual TRC 114 throughout a range of important shades or colors. As described above, the developer 1058 urges toner or colorant toward the latent image, and the development sensor 1074 senses the resultant toner or colorant images. As directed by the supervising controller 1090, the curve fitter receives information from the development sensor and calculates an estimate of the entire actual TRC 114. The actual TRC analyzer 1082 and control point optimizer work in concert to determine if improvement can be made in the selection of level 2 control point target densities. If improvement can be made, the control point optimizer 1086 delivers new or updated level 2 target densities to the level 2 controller 1026.

Additionally, the exemplary system 1000 may include a level 3 controller (not shown) operative to compensate for residual errors in the actual TRC 914. For example, the level 3 controller may generate a color correction lookup table to be applied in an image path (not shown) of the electrophotographic system 1000. Where level 3 control is provided, the efforts of the actual TRC analyzer 1082 and control point optimizer 1086 may be directed toward minimizing a control effort required of the level 3 control. Alternatively, or additionally, the actual TRC analyzer 1082 and control point optimizer 1030 may be directed toward minimizing a number of occurrences 322 of pluralities of input values being mapped to the same color corrected output value of the color correcting table, and toward reducing a number of and/or severity of jumps 330 in output values associated with consecutive input values of the color correcting lookup tables.

Furthermore, the exemplary electrophotographic system 1000 may include level 4 controls (not shown). Level 4 controls may, for example, change the target TRC 118 according to measurements made of an image rendered on a print medium such as paper (not shown) and target measurements associated therewith.

The exemplary system 1000 has been described in terms of a number of elements. The elements may appear to be implemented in separate components or devices. However, many of the separate elements can be implemented as separate aspects of a single component. For example, the first level 1 control 1042, second level 1 controller 1054, third level 1 controller 1066, level 2 controller 1026, supervising controller 1090, curve fitter 1078, actual TRC analyzer 1082, and control point optimizer 1086 may all be implemented as separate aspects of a single device. For instance, the single device might be a micro controller, microprocessor, digital signal processor, or other computational device in association with peripheral devices such as read only memory, random access memory, computer networks, mass storage devices, and/or other peripheral components. For example, the read only memory may contain program instructions for implementing the level 1 controllers 1042, 1054, 1066, the level 2 controller 1026, the supervising controller 1090, and the means for optimizing 1030 an aspect of the first set of system performance measurements (e.g., target densities). Alternatively, the exemplary system may be implemented with a more modular design. For instance, each of the level 1 controllers 1042, 1054, 1066 may be implemented in a separate micro controller. Those skilled in the art will understand that the functionality of the components of the exemplary system 1000 can be provided in a wide range of hardware and software configurations.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A method operative to control an electrophotographic system, the method comprising:

measuring an actual tone reproduction curve;

comparing the actual tone reproduction curve to a target tone reproduction curve; and changing at least one point at which the actual tone reproduction curve is controlled to minimize error in the actual tone reproduction curve.

2. The method of claim 1 wherein changing at least one point at which the actual tone reproduction curve is controlled comprises changing a target density of a control patch.

3. The method of claim 2 wherein changing a target density of a control patch comprises changing a point along the actual tone reproduction curve at which the actual tone reproduction curve is anchored to the target tone reproduction curve by a control effort of a developability control loop.

4. The method of claim 1 further comprising compensating for residual errors in the actual tone reproduction curve by adjusting contone values in an image path, the changing at least one point at which the actual tone reproduction curve is controlled being operative to reduce a magnitude of the contone value adjusting.

5. The method of claim 1 further comprising compensating for residual errors in the actual tone reproduction curve by adjusting contone values in an image path, the changing at least one point at which the actual tone reproduction curve is controlled being operative to reduce a number of contone values adjusted.

6. A method operative to minimize contouring in an electrophotographic system, the method comprising:

selecting a target tone reproduction curve;

selecting target level 2 default test patch densities;

selecting target level 3 test patch densities for measuring an actual tone reproduction curve;

developing level 2 default test patches based on the selected target level 2 default test patch densities;

measuring actual level 2 test patch densities;

determining a level 2 error between the actual level 2 test patch densities and the target level 2 default test patch densities;

adjusting at least one level 2 actuator based on the determined level 2 error;

developing level 3 default test patches based on the selected target level 3 default test patch densities;

measuring actual level 3 test patch densities;

determining a level 3 error between the actual level 3 test patch densities and the target level 3 test patch densities;

determining a new target level 2 test patch density based on the determined level 3 error;

developing the new level 2 test patch based on the new level 2 target test patch density;

measuring a new actual level 2 test patch density;

determining a new level 2 error between the new actual level 2 test patch density and the new target level 2 default test patch density; and adjusting the at least one level 2 actuator based on the determined new level 2 error.

7. The method of claim 6 wherein determining a level 3 error comprises:

fitting a curve to the measured actual level 3 test patch densities; and comparing the fitted curve to the target tone reproduction curve.

8. The method of claim 7 wherein comparing the fitted curve to the target tone reproduction curve comprises determining a difference between the fitted curve and the target tone reproduction curve.

9. The method of claim 6 wherein determining a new level 2 target test patch density comprises:

selecting a new level 2 target test patch density so as to reduce an area between a measured tone reproduction curve and an actual tone reproduction curve.

10. The method of claim 9 wherein selecting a new level 2 target test patch comprises attempting to make a first average area, between a first region of the actual tone reproduction curve and the target tone reproduction curve, equal to a second average area, between a second region of the actual tone reproduction curve and target tone reproduction curve.

11. The method of claim 10 wherein selecting a new level 2 target test patch comprises attempting to make a third average area, between a third region of the actual tone reproduction curve and the target tone reproduction curve, equal to the second average area, between the second region of the actual tone reproduction curve and the target tone reproduction curve.

12. An electrophotographic system comprising:

a level 1 control loop for maintaining a developability actuator at a developability actuator set point;

a level 2 control loop for assigning a value to the developability set point based on a first set of system performance measurements, thereby providing a first order correction; and, means for optimizing an aspect of the first set of system performance measurements, thereby minimizing an aspect of error in an actual tone reproduction curve.

13. The electrophotographic system of claim 12 further comprising:

a level 3 control loop for providing image path corrections based on a second set of system performance measurements, thereby providing a second order correction, the actions of the means for optimizing an aspect of the first set of system performance measurements being operative to minimizing the corrections provided by the level 3 control loop and/or side effects thereof.

14. The electrophotographic system of claim 12 wherein the level 1 control loop comprises a development voltage control loop for maintaining a development voltage at a development voltage set point.

15. The electrophotographic system of claim 12 wherein the level 1 control loop comprises a cleaning voltage control loop for maintaining a cleaning voltage at a cleaning voltage set point.

16. The electrophotographic system of claim 12 wherein the level 1 control loop comprises a laser power control loop for maintaining a laser power at a laser power set point.

17. The electrophotographic system of claim 13 wherein the level 2 control loop comprises a colorant density control loop operative to adjust at least one of a bias voltage, a cleaning voltage, a laser power and a wire AC voltage, in order to maintain an actual colorant density at a target colorant density.

18. The electrophotographic system of claim 13 wherein the level 3 control loop comprises a colorant density control loop operative to adjust image contone values in order to maintain an actual colorant density at a target colorant density.

19. The electrophotographic system of claim 17 wherein the means for optimizing an aspect of the first set of system performance measurements comprises a means for selecting the target colorant density so as to reduce a control effort needed from the level 3 control loop.

20. The electrophotographic system of claim 17 wherein the means for optimizing an aspect of the first set of system performance measurements comprises a means for selecting the target colorant density so as to reduce a contouring effect resulting from control efforts of the level 3 control loop.

21. The electrophotographic system of claim 12 wherein the first set of performance measurements comprises a first set of measured control patch densities, the measured control patch densities being related to target control patch densities, the level 2 control loop being directed toward aligning an actual tone reproduction curve with a target tone reproduction curve at at least points on the respective curves related to the target control patch densities, the means for optimizing an aspect of the first set of system performance measurements comprising a processor and a procedure performed by the processor, the procedure including comparing the target tone reproduction curve to a measurement of the actual tone reproduction curve, determining a sign of a desirable change in at least one target control patch density based on the comparison of the target tone reproduction curve and the actual tone reproduction curve, determining a magnitude of the desirable change in the at least one target control patch density based on the comparison of the target tone reproduction curve and the actual tone reproduction curve, and changing the at least one target control patch density based on the determined sign and the determined magnitude.

22. The electrophotographic system of claim 12 wherein the level 1 controller is operative to maintain a xerographic actuator at a developability actuator set point.

* * * * *